US005624891A

United States Patent [19]

Smialowicz et al.

[11] Patent Number: 5,624,891

[45] Date of Patent: Apr. 29, 1997

[54] DRAIN OPENING COMPOSITIONS THICKENED WITH N-ALKYL-N-ACYL AMINO ACIDS AND MYRISTYL/CETYL DIMETHYL AMINE OXIDES

[75] Inventors: Dennis T. Smialowicz, Waldwick; Ernest J. Sachs, Carlstadt; Edward M. Cooney, III, West Orange, all of N.J.

[73] Assignee: Reckitt & Colman Inc., Montvale, N.J.

[21] Appl. No.: 590,704

[22] Filed: Jan. 29, 1996

Related U.S. Application Data

[63] Continuation of Ser. No. 255,137, Jun. 7, 1994, abandoned.

[51] Int. Cl.[6] ..... C11D 1/10; C11D 1/75; C11D 3/395; C11D 3/08

[52] U.S. Cl. ..... 510/195; 510/191; 510/427; 510/433; 510/490; 510/367; 510/370; 510/373; 510/496; 510/503; 510/499; 510/511

[58] Field of Search ..... 252/547, 156, 252/546, 135, 94, 526, 527, 528, 535; 510/195, 191, 427, 433, 490, 367, 370, 373, 496, 503, 499, 511

[56] References Cited

U.S. PATENT DOCUMENTS

| | | | |
|---|---|---|---|
| 3,931,034 | 1/1976 | Inamorato et al. | 252/132 |
| 4,081,395 | 3/1978 | Talley | 252/106 |
| 4,229,313 | 10/1980 | Joy | 252/98 |
| 4,271,030 | 6/1981 | Brierley et al. | 252/98 |
| 4,368,147 | 1/1983 | Inamorato et al. | 252/545 |
| 4,388,204 | 6/1983 | Dimond et al. | 252/98 |
| 4,588,514 | 5/1986 | Jones et al. | 252/98 |
| 4,666,222 | 5/1987 | Martin et al. | 252/99 |
| 4,839,077 | 6/1989 | Cramer et al. | 252/98 |
| 4,900,467 | 2/1990 | Smith | 252/95 |
| 5,011,538 | 4/1991 | Smith | 134/22.13 |
| 5,055,219 | 10/1991 | Smith | 252/102 |
| 5,164,118 | 11/1992 | Sauer et al. | 252/356 |
| 5,462,689 | 10/1995 | Choy et al. | 252/90 |
| 5,549,842 | 8/1996 | Chang | 510/191 |

FOREIGN PATENT DOCUMENTS

| | | |
|---|---|---|
| 253676 | 7/1986 | European Pat. Off. . |
| 1823 | 3/1986 | WIPO . |

*Primary Examiner*—Michael P. Tierney
*Attorney, Agent, or Firm*—Frederick H. Rabin

[57] ABSTRACT

A thickened composition comprises:

(a) an active cleaning component, present in a cleaning effective amount; and (b) a thickening system comprising an alkali metal salt of an N-alkyl-N-acyl amino acid and a mixture of myristyl/cetyl dimethyl amine oxides. In a preferred embodiment, the cleaning composition comprises an alkali metal hypochlorite and a strong base comprising an alkali metal hydroxide and an alkali metal silicate. The thickened compositions are useful as hard surface cleaners and particularly useful as drain opening compositions.

9 Claims, No Drawings

DRAIN OPENING COMPOSITIONS THICKENED WITH N-ALKYL-N-ACYL AMINO ACIDS AND MYRISTYL/CETYL DIMETHYL AMINE OXIDES

This application is a continuation of application Ser. No. 08/255,137, filed 7 June, 1994, now abandoned.

FIELD OF THE INVENTION

The present invention is directed to compositions that are useful as cleaners. Because of their desirable rheological properties, they can be used on surfaces that require high viscosity such as toilet bowls and other similar vertical surfaces. The compositions of the invention are particularly useful as drain opening and cleaning compositions.

BACKGROUND OF THE INVENTION

There are many instances where thickened cleaning compositions are useful. For example, on vertical surfaces, it is useful to have a thickened composition to maintain the composition on the surface for a sufficient length of time to accomplish its purpose. In addition, thickened caustic compositions of this type are known to be useful for cleaning and opening clogged household drains.

Typically, a combination of fatty substances, protein or cellulose fibers contribute to clogs in household drain pipes. Many commercially available liquid compositions are sold to open these clogged drain pipes. Thickened aqueous hypochlorite bleaches are amongst the various compositions known for this purpose.

One of the early compositions of this type is disclosed in U.S. Pat. No. 4,388,204. This patent discloses the use of a ternary thickener system containing an alkali metal salt of an N-alkyl, N-fatty acyl amino acid such as sodium lauroyl sarcosinate, an alkali metal salt of an alkyl sulfate and an alkali metal sulfate salt of an aliphatic ethoxylated alcohol. However, these compositions are disadvantageous primarily because they dissolve so rapidly. Therefore, they fail to reach the clog in the drain in many instances, before being severely diluted.

In U.S. Pat. No. 5,055,219 there is described a drain opening composition that is said to be improved over compositions such as described in '204 in that the composition contains a system of a quaternary ammonium compound (quat) and an organic counterion that provides for a composition has special viscoelastic properties. The composition, when poured into a clogged drain does reach the clog but coming out of the container, the composition has low viscosity and is difficult for consumers to pour easily. Splashing and delivery of more composition than desired is common. Related patents include U.S. Pat. Nos. 4,900,467 and 5,011,538.

The disclosure of the '219 patent is interesting however, since comparative examples show the unsuitability of compositions having sarcosinates alone as the thickening agent (table V). Another comparative example shows the use of myristyl/cetyl dimethyl amine oxide in the absence of the quat. Very low viscosity compositions are reported. Suitable compositions are obtained only with the quat in combination with the myristyl/cetyl dimethyl amine oxide.

Other references show the use of amine oxides in hypochlorite bleaching and cleaning compositions but these are branched chain amine oxides. We have found that the use of branched chain amine oxides does not give the properties desirable for drain opening compositions. (See U.S. Pat. No. 4,229,313)

Thus, there is a continuing need for thickened cleaning compositions, particularly those that are capable of cleaning out clogged drains. The composition desirably should be capable of going through standing water without substantial dilution.

SUMMARY OF THE INVENTION

In accordance with the present invention, there is provided a thickened aqueous cleaning composition that uses a combination of an alkali metal salt of N-alkyl-N-acyl amino acids and myristyl/cetyl amine oxides. Thus, in accordance with the present invention, there is provided a composition which comprises:

(a) an active cleaning component, present in a cleaning effective amount; and (b) a thickening system comprising an alkali metal salt of an N-alkyl-N-acyl amino acid and myristyl/cetyl dimethyl amine oxides.

In a preferred embodiment, the cleaning composition comprises an alkali metal hypochlorite and a strong base comprising an alkali metal hydroxide and an alkali metal silicate.

DETAILED DESCRIPTION OF THE INVENTION

In accordance with the present invention, the compositions are thickened with a thickening system comprising an alkali metal salt of N-alkyl-N-acyl amino acids and myristyl/cetyl dimethyl amine oxides. This combination gives highly desirable properties in spite of the fact that when used alone, the individual components do not give good properties. This thickening system provides for a conveniently pourable composition that is easily controlled by consumers yet still provides the advantage of a composition that will penetrate standing water and go directly to the clog. This is accomplished with a composition that does not have the viscoelastic properties and disadvantages of the compositions of '219 cited above.

The thickening system is present in an amount which provides for noticable thickening compared with water. Guidance with respect to the exact amounts is provided with the discussions of the individual components below, however, one of skill in this art can easily determine the amount necessary for any particular purpose.

An essential component of the compositions of the invention is an alkali metal salt of N-alkyl-N-acyl amino acid which are well known in this art. They are acid salts derived from the reaction of (1) N-alkyl substituted amino acids of the formula:

$$R_1—NH—CH_2—COOH$$

where $R_1$ is a linear or branched chain lower alkyl of from 1 to 4 carbon atoms, especially a methyl, for example, aminoacetic acids such as N-methylaminoacetic acid (i.e. N-methyl glycine or sarcosine), N-ethylaminoacetic acid, N-butylaminoacetic acid, etc., are with (2) saturated natural or synthetic fatty acids having from 8 to 18 carbon atoms, especially from 10 to 14 carbon atoms, e.g. lauric acid, and the like.

The salts that are useful thus can have the formula:

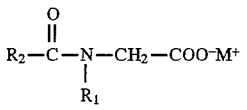

where M is an alkali metal ion such as sodium, potassium or lithium; $R_1$ is as defined above; and $R_2$ represents a hydrocarbon chain, preferably a saturated hydrocarbon chain, having from 7 to 17 carbon atoms, especially 9 to 13 carbon atoms.

The currently preferred alkali metal salt of an N-alkyl-N-acyl amino acid is sodium lauroyl sarcosinate which is commercially available, for example from Grace Company, Organic Chemicals Division as Hamposyl™ L-30.

The alkali metal salt of an N-alkyl-N-acyl amino acid is part of the thickening system and the exact amount depends on the other components, particularly the amine oxide component, but is generally present in an amount of from about 0.1 to about 3.0 weight percent of the composition, preferably between about 0.3 and 2.0 weight percent.

The other essential component of the thickening system is myristyl/cetyl dimethyl amine oxides. The ratio of the myristyl portion of the mixture to the cetyl portion of the mixture can be adjusted to provide desirable properties for various embodiments of the compositions of the invention. Where lower viscosity and higher rates of dissolution are needed, for example for a toilet bowl cleaner, more myristyl portion can be used, (up to about 100%). For thicker drain clog compositions, requiring higher viscosity and slower dissolution, more cetyl portion (up to 100%) can be used. With this understood, the ratio of myristyl to cetyl is preferably between about 0.25/0.75 to 0.75/0.25.

Mixtures of myristyl/cetyl dimethyl amine oxides are commercially available for example from the Stepan Co. as Ammonyx™ MCO.

The exact amount of the myristyl/cetyl dimethyl amine oxides, as with the other component of the thickening system, varies depending on the exact nature of the other component but is generally present in an amount of from about 0.05 to about 5.0 weight percent of the composition, preferably between about 0.1 and 3.0 weight percent.

The other essential component of the compositions of the invention is an active cleaning component. Useful cleaning components include acids, bases, oxidants, reductants, solvents, enzymes, thioorganic compounds, surfactants (detergents) and mixtures thereof. Examples of useful acids include: carboxylic acids such as citric or acetic acids, weak inorganic acids such as boric acid or sodium bisulfate, and dilute solutions of inorganic acids such as sulfuric acid. Examples of bases include the alkali metal hydroxides, carbonates and silicates and specifically the sodium and potassium salts thereof.

Oxidants, e.g. bleaches are particularly preferred cleaning components and may be selected from various halogen or peroxygen bleaches. Examples of suitable peroxygen bleaches include hydrogen peroxide and peracetic acids.

Enzymes can be used such as proteases, amylases and cellulases. Biologically active bacteria can be included. Solvents can be used in the cleaning component such as saturated hydrocarbons, ketones, carboxylic acid esters, terpenes, glycol ethers and the like. Thioorganic compounds such as sodium thioglycolate can be included in the cleaning component to help break down hair and other proteins.

The most preferred cleaning component includes a bleach source selected from various hypochlorite producing species, for example, halogen bleaches selected from the group consisting of the alkali metal and alkaline earth salts of hypohalite, haloamines, haloimines, haloimides and haloamides. Representative hypochlorite producing compounds include sodium, potassium, lithium and calcium hypochlorite.

The currently preferred cleaning component is a mixture of sodium hypochlorite which serves to dissolve hair that may be found in a drain clog; and a strong base which serves to dissolve fats and greases that may also be found in a clog. Useful strong bases include alkali metal hydroxides, carbonates and silicates and specifically the sodium and potassium salts thereof. The currently preferred strong base is a mixture of sodium hydroxide, preferred because it is easily available and inexpensive, and sodium metasilicate pentahydrate. The sodium metasilicate pentahydrate contributes to the alkalinity and also is a corrosion inhibitor for metals.

The amount of cleaning component varies widely and depends on the intended use and the nature of the component and one of skill in this art can easily determine the cleaning effective amount for any particular purpose. Thus, for a hard surface cleaner, a mild cleaning component in a low to modest concentration may be used. For a caustic drain opening composition, high concentrations of strong cleaners may be used. With this as guidance, the cleaning component is generally present in an amount of from about 0.10 to about 25.0 weight percent of the composition.

In the preferred embodiment, the composition is a drain opening composition wherein the cleaning component is a combination of a hypochlorite and a strong base. The hypochlorite is generally present in an amount of from about 0.10 to about 15.0 weight percent of the composition, preferably between about 2.0 and 10.0 weight percent. The strong base is generally present in an amount of from about 0.10 to about 24.9 weight percent of the composition, preferably between about 0.2 and 6.0 weight percent.

In addition to the above described essential components, the compositions of the invention can contain numerous optional components. One particularly preferred optional component is a disulfonate such as sodium dodecyl diphenyloxide disulfonate, commercially available from Dow Chemical as Dowfax™ 2A1. This component contributes to the phase stability of the composition at both high and low temperatures. This component is generally present in an amount of from about 0.0045 to about 1.0 weight percent of the composition, preferably between about 0.225 and 0.45 weight percent.

Particularly where the composition is used as a surface cleaner, other surfactants can be included in the composition to improve wetting and leveling. Preferred surfactants for this purpose include fluorosurfactants for example, anionic, nonionic, cationic and amphoteric fluorosurfactants marketed by E.I. Dupont de Nemours and Company under the trademark ZONYL™, e.g. ZONYL™ FSK, an amphoteric fluorosurfactant, ZONYL™ FSN, a fluorosurfactant, ZONYL™ FSJ, an anionic fluorosurfactant and ZONYL™ FSC, a cationic fluorosurfactant. The fluorosurfactant is generally present in an amount of from about 0.001 to about 1.0 weight percent of the composition, preferably between about 0.005 and 0.1 weight percent.

The compositions of the invention can include a wide variety of other optional components as is known in this art. The compositions can include fragrances, coloring agents such as dyes and pigments, whiteners, solvents, soil release polymers, bactericidal agents, chelating agents and builders, for example. The compositions can also include pH adjusting agents, buffers and the like.

The compositions of the invention are used in a conventional manner. For example, where the composition of the invention is formulated as a drain opening composition, the composition can be poured into standing water in the sink caused by a drain clog. The composition goes to the clog in the drain because of its viscosity, density and appropriate solubility in water. The composition is allowed to work for a time sufficient to break the clog. For a hard surface cleaner composition, the composition is applied to the surface to be cleaned, is allowed to stand for a period of time and is then wiped or rinsed off.

The compositions of the invention can be made by conventional methods. The components are simply mixed in aqueous solution with or without moderate heating as needed. It is preferred to mix the components of the composition in the order listed in Example 1, that is water is added to the sodium hypochlorite solution and then the other components are added in the order listed with thorough mixing.

The pH of the compositions of the invention is not critical. For the preferred drain opening composition, the pH is naturally quite high (10–14) due to the presence of the strong base.

The viscosity of the compositions of the invention depends on the exact concentration of the thickener system, as previously described. For the preferred drain opening composition, where the ratio of myristyl to cetyl is 0.25/0.75, the viscosity using a Brookfield spindle #2 at 30 rpm is generally between about 700 and 1100 cps although higher and lower viscosities are useful.

In the results below, the "delivery" is reported. This corresponds to the percentage of the composition that settles to the bottom of a container and is measured in a manner described in U.S. Pat. No. 5,055,219 cited above. More specifically, 20 mL of the test composition is poured into 80 mL of water at 73° F., typically in a graduated cylinder. The percent that appears at the bottom of the cylinder after two minutes is the "delivery" reported. Delivery is an indication of the solubility of the composition since if the composition is highly soluble, little of the composition will be delivered in this test.

The following examples are presented for a further understanding of the invention.

EXAMPLES

The following composition was prepared by mixing the described components in the amounts indicated (by weight of the completed composition):

| Component | Weight % |
|---|---|
| Sodium Hypochlorite | 10.0% |
| Sodium Hydroxide | 2.0% |
| Sodium Metasilicate Pentahydrate | 1.0% |
| Sodium Dodecyl Diphenyl Disulfonate | 0.1% |
| Sodium Lauroyl Sarcosinate | 0.9% |
| Cetyl/Myristyl Amine Oxide | 0.75% |
| Water Q.S. to 100.00% | |

Based on this general formulation, a series of compositions were made in which the ratio of myristyl to cetyl was changed. The viscosity and the delivery were measured with the following results:

| Myristyl/Cetyl Distribution | Viscosity (Cps) @ 25° C. | Delivery (%) |
|---|---|---|
| C16 0%<br>C14 100% | 270 | 0–5 |
| C16 25%<br>C14 75% | 400 | Not measured |
| C16 37.5%<br>C14 62.5% | 475 | Not measured |
| C16 50%<br>C14 50% | 545 | 50–60 |
| C16 62.5%<br>C14 37.5% | 640 | 70–75 |
| C16 75%<br>C14 25% | 730 | 90–100 |
| C16 100%<br>C14 0% | 1320 | 98–100 |

The composition wherein the ratio of myristyl/cetyl was 0.25/0.75 was tested for drain clog opening efficacy. The procedure used was as follows:

A mixture containing the basic food materials entering a kitchen drain (protein, starch, fat/grease, cellulose and grit) was prepared. This mixture was placed in the bottom of an 1.5 inch I.D. "S" trap of a kitchen sink to produce a clog. The "S" trap was made of glass so that the action of the composition to be tested could seen.

Ten liters of room temperature water was added to the sink, filling the "S" trap and the sink to a depth of about 14.5 inches. The composition to be tested was added, in the amount of 450 mL, to the sink reservoir, pouring it over the the drain from a height of 3–4 inches above the water surface.

When the composition was added to the water, it formed pillow shaped lobes which sank immediately to the bottom of the sink reservoir. The composition proceeded through the drain displacing all of the water above the clog in the "S" trap. Within 30 to 45 seconds of reaching the clog, the composition was observed attacking the clog through evidence of gas bubbles being generated. The composition broke through the clog and the reservoir drained.

A similar test was run except that the clog was formed from a combination of hair and greasy soap scum. This clog was also cleared by the composition.

The invention has been described in detail with particular reference to preferred embodiments thereof, but it will be understood that variations and modifications can be effected within the spirit and scope of the invention.

What is claimed is:

1. A composition for opening and cleaning clogged drains comprising (a) from about 0.1 to about 25 weight percent of an active cleaning component comprising (i) a hypochlorite-producing species and (ii) a strong base comprising an alkali metal hydroxide and an alkali metal silicate, and (b) a thickening system consisting of (i) from about 0.1 to about 3.0 weight percent, based on the composition, of an alkali metal salt of an N-alkyl-N-acyl aminoacetic acid, (ii) from about 0.0045 to about 1.0 percent, based on the composition, of a disulfonate, and (iii) from about 0.05 to about 5.0 weight percent, based on the composition, of a dimethyl amine oxide component selected from the group consisting of cetyl dimethylamine oxide or a mixture of myristyl and cetyl dimethylamine oxides in which the cetyl component is present in an amount of at least 25%.

2. A composition according to claim 1 in which, in the thickening system, the dimethyl amine oxide component consists only of cetyl dimethyl amine oxide.

3. A composition according to claim 1 in which the dimethyl amine oxide component is a mixture of myristyl and cetyl dimethyl amine oxides in which the ratio of myristyl to cetyl is from 25/75 to 75/25.

4. A composition according to claim 3 which comprises (a) a cleaning component comprising from about 2 to about 10 weight percent of sodium hypochlorite and from about 2 to about 6 weight percent of a strong base which is a mixture of sodium hydroxide and sodium metasilicate, and (b) a thickening system consisting of from about 0.5 to about 5.0 weight percent of a mixture of myristyl and cetyl dimethyl amine oxides in which the ratio of myristyl to cetyl is about 25/75, from about 0.225 to about 0.45 percent of sodium dodecyl diphenyloxide disulfonate and from about 0.3 to about 2.0 weight percent of sodium lauroyl sarcosinate.

5. A composition according to claim 1 wherein the alkali metal salt of an N-alkyl-N-acyl aminoacetic acid is sodium lauroyl sarcosinate.

6. A composition according to claim 1 wherein the hypochlorite-producing species is sodium hypochlorite.

7. A composition according to claim 1 wherein the alkali metal hydroxide is sodium hydroxide and the alkali metal silicate is sodium metasilicate pentahydrate.

8. A composition according to claim 7 in which the cleaning component comprises, based on the weight of the composition, from about 0.1 to about 15 percent of sodium hypochlorite and from about 0.1 to about 24.9 percent of the strong base.

9. A composition according to claim 1 wherein the disulfonate is sodium dodecyldiphenyloxide disulfonate.

* * * * *